US005870981A

United States Patent [19]

Knaus et al.

[11] Patent Number: 5,870,981

[45] Date of Patent: Feb. 16, 1999

[54] TWO-STROKE ENGINE HAVING SEVERAL TRANSFER CHANNELS

[75] Inventors: Konrad Knaus, Gaildorf; Peter Pretzsch, Schorndorf, both of Germany; Karel Jaros, Brno, Czech Rep.

[73] Assignee: Andreas Stihl, Waiblingen, Germany

[21] Appl. No.: 626,388

[22] Filed: Apr. 2, 1996

[30] Foreign Application Priority Data

Apr. 4, 1995 [DE] Germany ..... 195 12 566.5

[51] Int. Cl.[6] ..... F02B 25/14

[52] U.S. Cl. ..... 123/65 A; 123/73 PP

[58] Field of Search ..... 123/73 A, 73 PP, 123/65 W, 65 P, 65 A, 65 WA

[56] References Cited

U.S. PATENT DOCUMENTS

| | | | |
|---|---|---|---|
| 2,681,050 | 6/1954 | Schnurle | 123/65 A |
| 4,253,433 | 3/1981 | Blair | 123/73 A |
| 4,276,858 | 7/1981 | Jaulmes | 123/73 A |
| 4,287,860 | 9/1981 | Fujikawa et al. | 123/73 A |
| 4,353,333 | 10/1982 | Iio | 123/73 PP |
| 4,469,054 | 9/1984 | Onishi et al. | 123/73 A |

FOREIGN PATENT DOCUMENTS 3330701 4/1984 Germany .

*Primary Examiner*—Marguerite McMahon

*Attorney, Agent, or Firm*—Walter Ottesen

[57] ABSTRACT

A two-stroke engine for driving a crankshaft includes a cylinder defining a longitudinal elevation axis and having a top wall and a cylindrical side wall terminating in the top wall. A piston is mounted in the cylinder so as to be movable along the side wall for driving a crankshaft. The cylinder and the piston conjointly define a combustion chamber wherein combustion gases are generated during operation of the engine and the side wall of the cylinder has an exhaust window which opens into the combustion chamber for conducting away the combustion gases. The exhaust window defines a longitudinal center axis passing approximately through the elevation axis and the side wall of the cylinder has a surface portion lying opposite the exhaust window. A plurality of main channels and a plurality of support channels open into the combustion chamber for conducting fuel mixture into the combustion chamber. A first main channel and a first support channel are arranged on a first side of the center axis and a second main channel and a second support channel are arranged on a second side of the center axis. The first and second main channels have exit windows lying adjacent the exhaust window so as to cause the respective component main flows of fuel mixture to exit approximately horizontally toward the surface portion lying opposite the exhaust window. The first and second support channels have exit windows lying adjacent opposite sides of this surface portion and the support channels are so configured at the exit windows thereof to cause the component support flows to be directed upwardly along the side wall toward the top wall of the cylinder.

10 Claims, 5 Drawing Sheets

TWO-STROKE ENGINE HAVING SEVERAL TRANSFER CHANNELS

FIELD OF THE INVENTION

The invention relates to a two-stroke engine especially for a portable handheld work apparatus such as a motor-driven chain saw, brushcutter or the like.

BACKGROUND OF THE INVENTION

Two-stroke engines are simpler than four-stroke engines with respect to their configuration and operation. Mostly, they are lighter and therefore are used especially advantageously as drive engines in portable handheld work apparatus.

German patent publication 3,330,701 discloses a two-stroke engine wherein the transfer channels are subdivided into main channels and supporting channels in order to form scavenging flows of different intensity and direction. For this purpose, one main channel and one supporting channel are provided at both sides of a longitudinal center axis through the exhaust gas channel.

When scavenging the combustion chamber, it is basically unavoidable that portions of the uncombusted fresh gas flows off via the exhaust window before this window is closed by the upwardly-travelling piston. Nonetheless, combustion gases still remain in the combustion chamber which can disturb a subsequent combustion operation. On the one hand, this can lead to a loss in power and, on the other hand, to poor exhaust gas quality such as to increased hydrocarbon emissions.

SUMMARY OF THE INVENTION

The object of the invention is to improve a two-stroke engine in such a manner that a substantially complete fresh gas scavenging of the combustion chamber is possible with minimum scavenging losses while reducing the residual portions of combustion gases in the combustion chamber with providing high power and improving the quality of the exhaust gas.

The two-stroke engine of the invention is for driving a crankshaft. The engine is especially intended for a portable handheld work apparatus such as a motor-driven chain saw, a brushcutter or the like and includes: a cylinder defining a longitudinal elevation axis and having a top wall and a cylindrical side wall terminating in the top wall; a crankcase mounted below the cylinder for rotatably journalling the crankshaft; a piston mounted in the cylinder so as to be movable along the side wall between top dead center and bottom dead center for driving the crankshaft; the cylinder and the piston conjointly defining a combustion chamber wherein combustion gases are generated during operation of the engine; the side wall of the cylinder having an exhaust window formed therein so as to open into the combustion chamber for conducting away the combustion gases; the exhaust window defining a longitudinal center axis passing approximately through the elevation axis and the side wall of the cylinder having an inner wall surface portion lying opposite the exhaust window; a plurality of main channels opening into the combustion chamber for conducting respective component main flows of fuel mixture into the combustion chamber; a plurality of support channels opening into the combustion chamber for conducting respective component support flows of fuel mixture into the combustion chamber; a first main channel and a first support channel arranged on a first side of the center axis and a second main channel and a second support channel arranged on a second side of the center axis; the first and second main channels having first and second main channel exit windows lying adjacent the exhaust window so as to cause the respective component main flows to exit approximately horizontally toward the inner wall surface portion; the first and second support channels having first and second support channel exit windows lying adjacent opposite sides of the inner wall surface portion; and, the support channels being so configured at the exit windows thereof to cause the component support flows to be directed upwardly along the side wall toward the top wall.

The component flow of the main channels flows near the base of the piston in the direction toward the exit window of the support channels and below the component flows exiting from the support channels. The main channel component flows are raised by the supporting channel component flows which flow near the cylinder wall in the direction toward the roof of the combustion chamber. Accordingly, first the exhaust gas near the base of the piston is displaced by the in-flowing component flows of the fresh gas. The component flows are directed upwardly in common close to the wall in the direction toward the roof of the combustion chamber and accumulate behind the exhaust gas cloud which is formed in the combustion chamber and drive this cloud to the exhaust window. The rising scavenging flow is deflected at the roof of the combustion chamber in the direction toward the piston base and then flows downwardly on the cylinder wall region containing the exhaust window. Before the scavenging flow reaches the exhaust window, this window is closed by the piston which, in the meantime, travels upwardly so that the scavenging losses are low. The nature of the configuration of the transfer channels thereby ensures an optimal scavenging with a low residual gas component. In this way, high power is provided in combination with a low exhaust of toxic substances. Especially the hydrocarbon substance emissions are low. This is apparently facilitated by the main channel flow which flows in near the base of the piston. The main channel flow ensures a continuous effective cooling of the piston base because of its large volume.

Preferably, the upper control edge of the exit window of the main channel lies lower than the control edge of the exit window of the support channel by a crankshaft angular amount of preferably 0° to 5°. In this way, the component flows exiting from the support channels can form a scavenging flow directed toward the roof of the combustion chamber and close to the wall before the main channel component flows, which define a large volume, enter into the combustion chamber. A rapid, low-loss raising of the main channel component flow is ensured by the collision with the scavenging flow of the support channels already formed.

Preferably, the roof of the channel section of the main channel extending from the exhaust window in the direction toward the piston base is inclined at an angle of 0° to 15°, preferably at an angle of 10°. In this way, it is ensured that the main channel component flow passes over the piston base whereby excellent cooling is obtained. If the main channel component flow impinges upon the piston base in advance of joining with the support channel component flow, then the main channel component flow already receives a deflection pulse in a direction toward the roof of the combustion chamber. This deflection pulse then favors raising up the main channel component flow by the support channel component flow.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
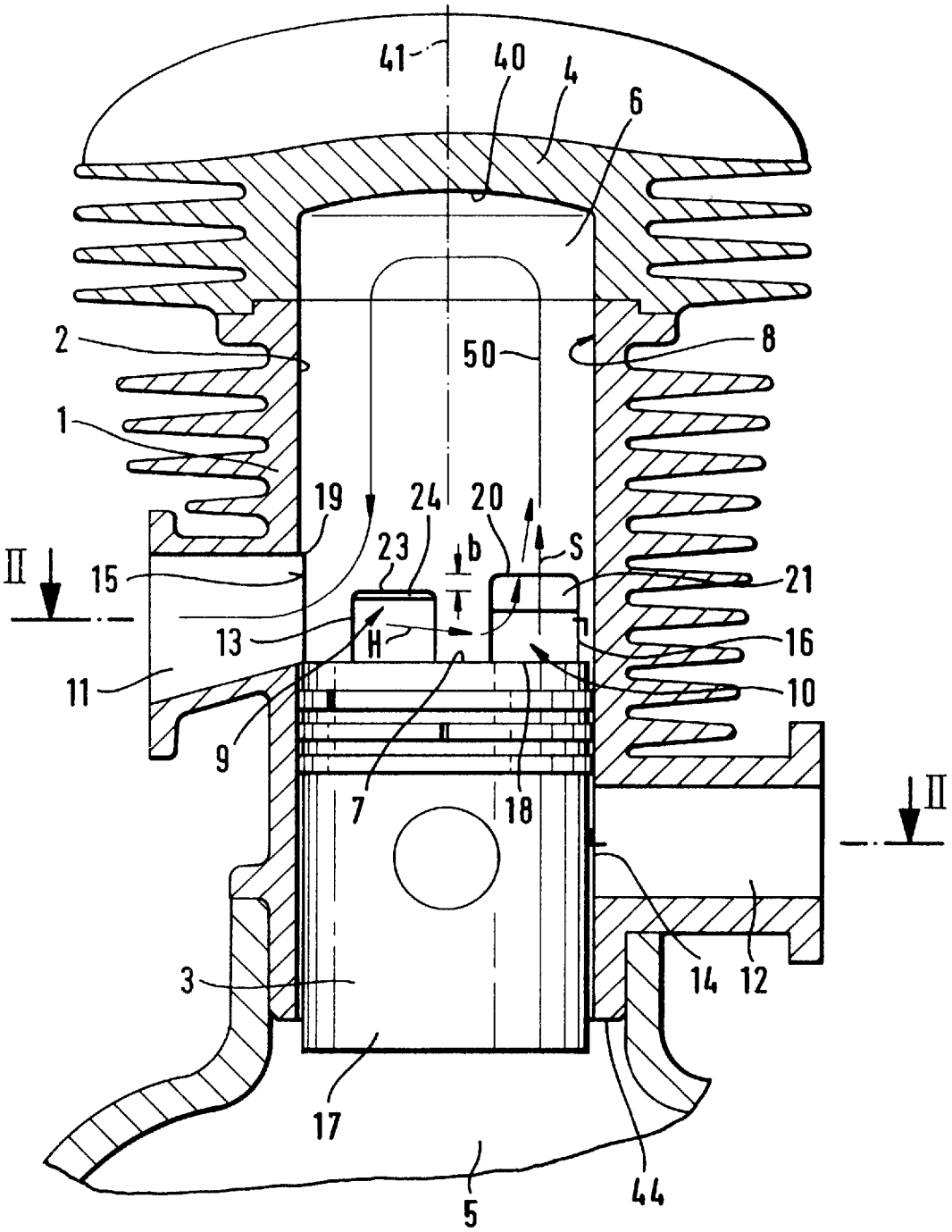
FIG. 1 is a section view through the cylinder of a two-stroke engine.

In FIG. 1, a slit-controlled two-stroke engine is shown as it can be used, for example, as a drive motor in a portable handheld work apparatus such as a motor-driven chain saw, a brushcutter apparatus, a cutoff machine or the like.

Such a two-stroke engine comprises at least a cylinder 1 having a bore 2 in which a piston 3 is guided for upward and downward movement. The cylinder 1 is closed at one end by a cylinder head 4. The other end is attached to a crankcase 5 in which a crankshaft is journalled and rotatably driven by the up and down moving piston 3.

A combustion chamber 6 is formed in the cylinder and is delimited by the cylinder wall 8, the cylinder head 4 and the piston base 7. The combustion chamber is connected via transfer channels 9 and 10 to the crankcase 5. The transfer channels (9, 10) include exit windows (13, 16), respectively, formed in the cylinder wall B. The combustion chamber 6 further includes an exhaust window 15 having an exhaust channel 11 extending therefrom for conducting away the occurring combustion gases. An inlet window 14 with a mixture-supplying input channel 12 is arranged in the foot region of the cylinder 1. The inlet window 14 opens into the crankcase 5. The windows (13, 16, 15, 14) of the channels (9, 10, 11, 12), respectively, lie in the cylinder wall 8 and are opened and closed by the upwardly and downwardly moving piston 3 in dependence upon its stroke position.

In the position of the piston shown in FIG. 1, the piston lies at the region of bottom dead center referred to a crankshaft rotation, that is, at approximately 180°. The component flows H and S of the mixture enter from the transfer channels 9 and 10 and scavenge the combustion chamber 6 and displace occurring combustion gases into the exhaust channel 11 via the exhaust window 15. With the upward movement of the piston 3 which follows in the direction toward the cylinder head 4, the exit windows 13 and 16 of the transfer channels 9 and 10, respectively, are first closed and then the exhaust window 15 is closed. At the same time, the piston skirt 17 opens the inlet window 14 of the inlet channel 12 so that a fresh mixture is drawn by suction into the crankcase 5 therethrough.

On its way toward top dead center, the piston 3 compresses the mixture in the combustion chamber 6 and then, after the ignition of the mixture, again moves downward in the direction toward bottom dead center because of the pressure of the explosion in the combustion chamber.

The piston edge 18 then first travels over the control edge 19 of the exhaust window 15 so that the combustion gases being at an overpressure can escape via the exhaust channel 11.

Figure 4:
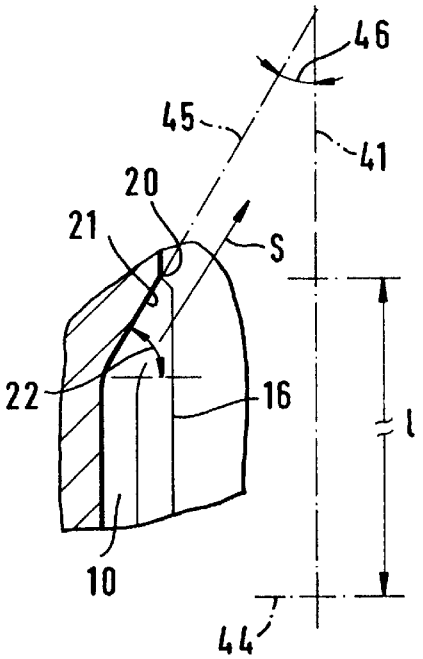
FIG. 4 is a detail section view along line IV—IV of FIG. 2.

With a further downward movement, the piston edge 18 first passes over the upper control edge 20 of the exit window 16 of a transfer channel which is configured as support channel 10. The channel section which extends from exit window 16 has a planar roof 21 which is directed upwardly with respect to the roof 40 of the combustion chamber which is configured in the cylinder head 4 (FIG. 4). The angle 22 of inclination opens to the combustion chamber 6. The angle 22, measured from the horizontal has a magnitude of approximately 35° to 65°, preferably 55° to 60°. The plane 45 is defined by the roof 21 and intersects the cylinder elevation axis 41 at an angle 46 of 25° to 55°, preferably 30° to 35°. A first component flow S enters the combustion chamber 6 via this upwardly directed roof 21. This first component flow S rises near the cylinder wall 8 and flows to the roof 40 of the combustion chamber.

Figure 3:
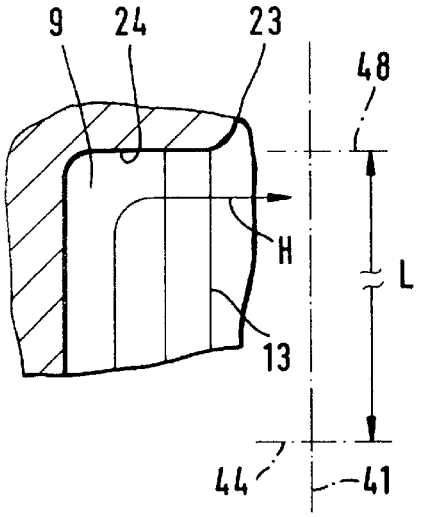
FIG. 3 is a detail section view along line III—III of FIG. 2.

With a further downward movement of the piston (preferably at several degrees later of the crankshaft angle), the control edge 23 of the exit window 13 of a transfer channel is passed over whereby a second component flow H enters to scavenge the combustion chamber 6. The transfer channel is configured as the main channel 9. The channel section which extends from the exit window 13 is delimited by a roof 24 which lies in a plane to which the cylinder elevation axis 41 is approximately perpendicular (FIG. 3).

Figure 2:
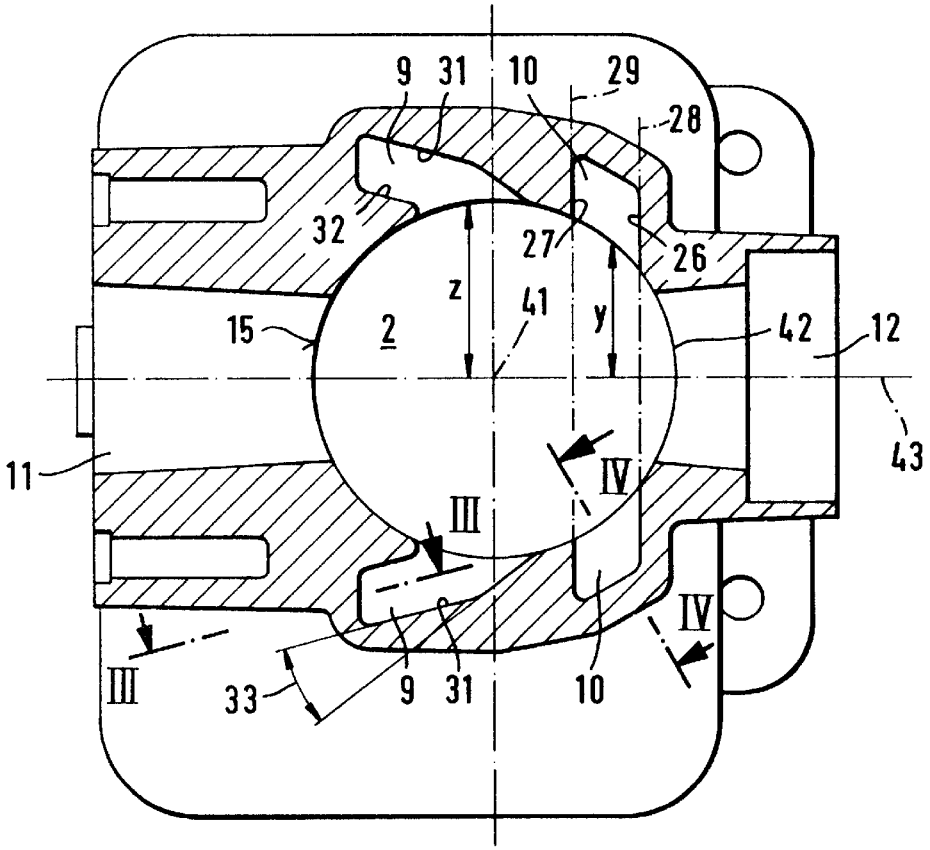
FIG. 2 is a section view taken along line II—II of FIG. 1.

As shown in FIG. 2, the flow exit of the main channel 9 adjacent the exhaust window 15 is directed toward a cylinder wall region 42 which lies approximately opposite the exhaust window 15. The orientation of the main channel 9 is approximately tangential to the cylinder bore 2 so that the component flow H enters tangentially into the combustion chamber 6. The component flow H enters from the main channel 9.

The support channels 10 are arranged closely adjacent to the cylinder section 42 and the component flows H of the main channel 9 are aligned in their direction. The support channels 10 have a flow outlet lying approximately on a secant to the cylinder bore 2. The roof 24 of the main channel 9 (FIG. 3) lies approximately parallel to the piston base 7. Because of the roof 24, the component flow H of channel 9 flows approximately horizontally over the piston base 7 and is directed upwardly in the direction toward the roof 40 of the combustion chamber when colliding with the component flows S of the support channels 10.

As FIG. 1 shows, the component flows H and S combine to a common scavenging flow 50 which rises toward the roof 40 of the combustion chamber. This scavenging flow 50 again flows downwardly on the cylinder wall 8 after reaching the roof 40. In this way, a complete scavenging of the combustion chamber 6 is ensured. Before the flow 50 reaches the exhaust window 15, the piston 3 closes the latter because of the stroke movement which occurs in the meantime so that scavenging losses hardly occur. The portion of residual gas in the combustion chamber 6 is minimized by this targeted scavenging of the chamber 6. In this way, maximum power is obtained with only minimal hydrocarbon emissions occurring. The guidance of the component flow H of the main channel 9 over the piston base 7 ensures adequate cooling of the piston.

As shown in FIG. 2, the arrangement of the transfer channels is symmetrical to a horizontal longitudinal center axis 43 which extends through the center of the exhaust window 15 and the cylinder elevation axis 43. Two main channels 9 are provided which are opened simultaneously and two support channels 10 are provided which are likewise opened simultaneously. As shown in the embodiment of FIG. 1, both support channels 10 are opened at the same time and earlier than the main channels 9 (which are also opened simultaneously) by a crankshaft angular amount (b) of approximately 0° to 5°. In this way, it is ensured that the component flow S exiting from the support channel 10 can form a scavenging flow directed upwardly close to the wall so that when the main transfer channel 9 opens, its entering component flow H is directed upwardly toward the roof 40 of the combustion chamber and is entrained by the scavenging flow.

As shown in FIG. 2, the exit windows 13 of the main channels 9 are at a greater distance (z) from the longitudinal center axis 43 than the exit window 16 of the support channels 10. Seen in the axial direction of the exhaust channel 11, the exit windows 13 of the main channels 9 lie approximately at the elevation of the cylindrical elevation axis 41; whereas, the exit windows 16 of the support channels 10 lie directly on the wall region 42. The spacing (y) to the longitudinal center axis 43 is less than the spacing (z) and is selected as small as possible.

As shown schematically in FIGS. 3 and 4, the length L of the main channel 9 is measured from the lower edge 44 (FIG. 1) of the cylinder bore 2 and is equal to the axial length L' of the support channel 10. This results in the control edge 20 of the support channel 10 being at the same elevation as the control edge 23 of the main channel 9. Support and main channels 9 and 10 are therefore opened and closed simultaneously.

Figure 5:
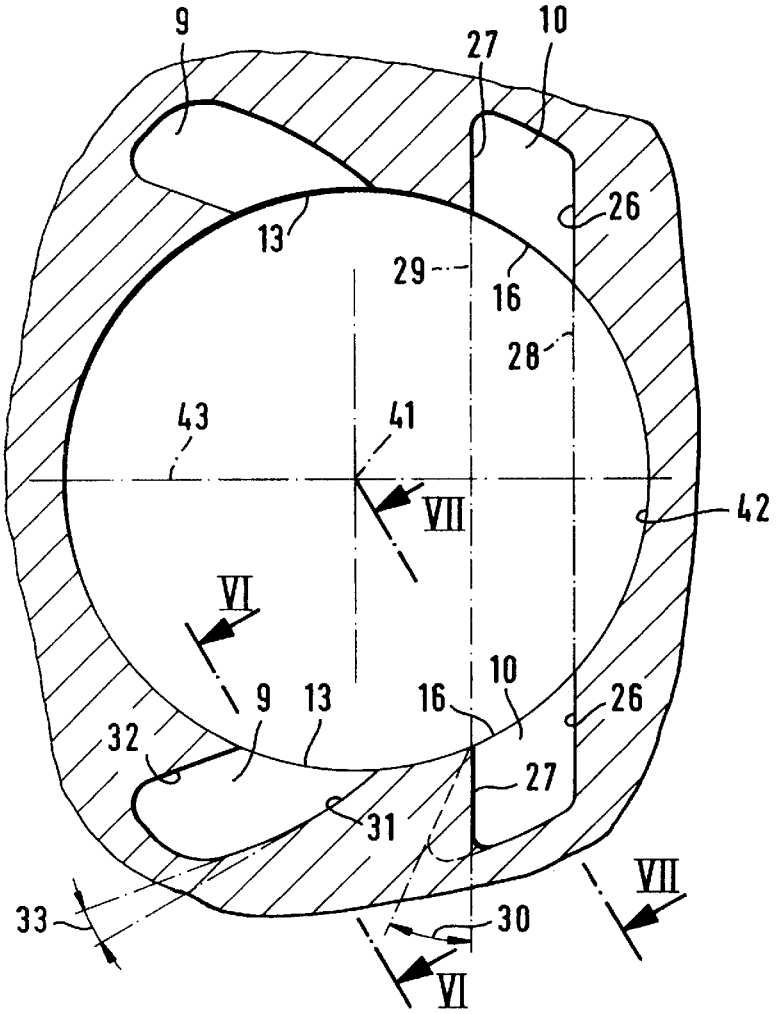
FIG. 5 is a schematic representation of the arrangement of the transfer channels in a section view corresponding to that of FIG. 2.

The side walls 26 and 27 of the support channels 10 preferably lie in respective common planes 28 and 29 (FIG. 5). The longitudinal center axis 43 defines the axis of symmetry and is perpendicular to these planes 28 and 29. Preferably, the side wall 27 adjacent the main channel 9 is at an angle 30 to the plane 28 or 29 such that the side wall 27 extends in a direction toward the exit window 16 of the support channel on the other side wall 26. The angle 30 preferably is 10° to 20°. In the same manner, a side wall section 31 of the main channel 9 can lie in a direction running to its other side wall 32. The side wall section 31 lies directed toward the support channel 10. As shown in FIG. 5, the side wall section 31 is bent at an angle 33 of approximately 10°.

Figure 6:
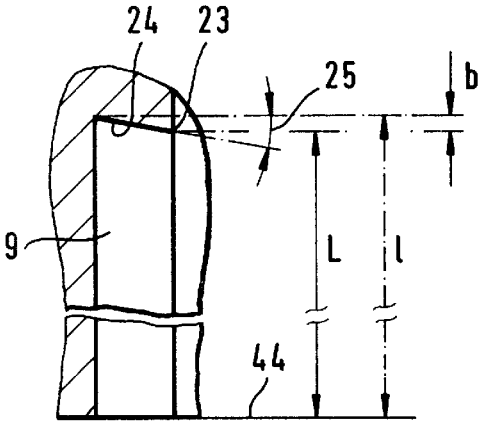
FIG. 6 is a detail section view taken along line VI—VI of FIG. 5.

As shown in FIG. 6, the horizontal roof 24 of the main channel 9 can be inclined at an angle 25 of inclination of approximately 0° to 15° with respect to the piston base 7. In this way, a component flow H results which is directed onto the piston base 7. The component H is raised upwardly by the component flow S of the support channel 10 toward the roof 40 of the combustion chamber after impinging on the piston base 7.

Figure 7:
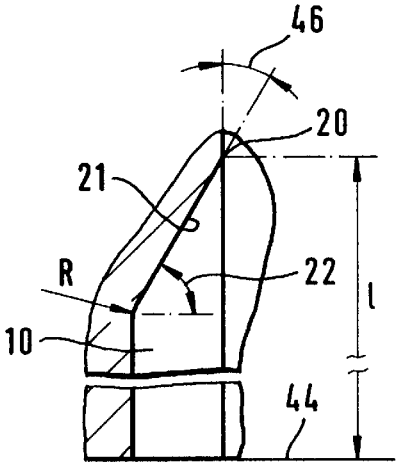
FIG. 7 is a detail section view taken along line VII—VII of FIG. 5.

The inclination angle 22 for the roof 21 of the support channel 10 advantageously is 60° as shown in FIG. 7.

In the embodiment of FIGS. 6 and 7, the axial length L of the main channel 9 is made less than the axial length L' of the support channel 10. In this way, an axial position difference (b) of the control edges 20 and 23 is provided. Accordingly, the control times of the support and main channels are different. The support channel 10 is opened in time in advance of the main channel 9.

Figure 8:
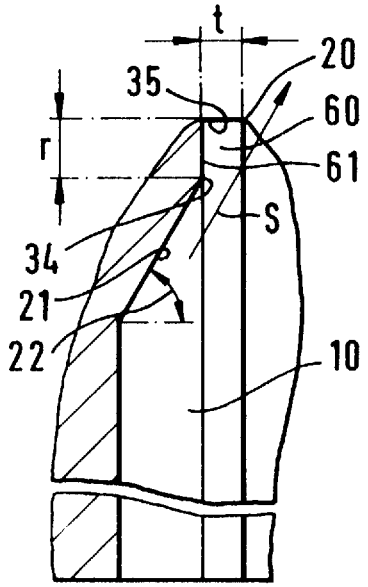
FIG. 8 is a detail section view taken through a support channel in a view corresponding to FIG. 7.

As shown in FIG. 8, a horizontal peripheral step 60 can be provided on the edge 34 of the roof 21 adjacent the combustion chamber 6. The peripheral edge 60 functions to impart turbulence to the entering component flow S. The turbulence contributes to a good thorough mixing at optimal scavenging of the combustion chamber 6.

The horizontal peripheral edge 60 has a preferably planar surface 35 onto which the flow impinges. This surface 35 defines a plane to which the cylinder elevation axis 41 is perpendicular. The edge of the surface 35 facing toward the combustion chamber defines the control edge 20 of the support channel 10. The peripheral step 60 has a depth (r) and a width (t) and a stepped back 61 is defined by the depth (r). The plane of the stepped back 61 is parallel to the cylindrical elevation axis and is preferably at right angles to the surface 35. The depth (r) and the width (t) of the peripheral step lie in the range of 0 to 4 mm and preferably have a dimension of 1 mm.

The transfer channels 9 and 10 are configured axially to have a length as long as possible to obtain a centering of the component flows S and H. Preferably, the channels 9 and 10 are introduced into the cylinder wall 8 as axial grooves which are each open to the crankcase 5 at their respective ends.

Figure 9:
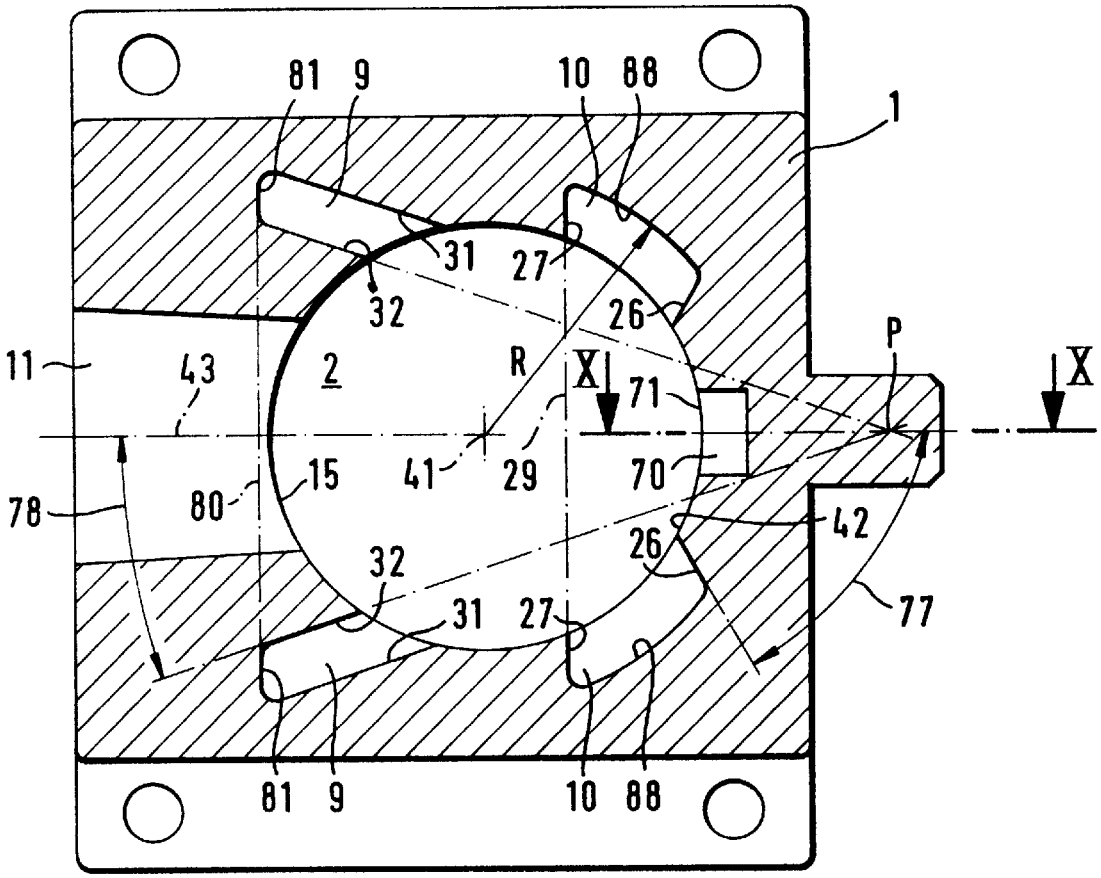
FIG. 9 is a section view taken through a cylinder having a membrane-controlled inlet channel in a section view corresponding to that of FIG. 2.
Figure 10:
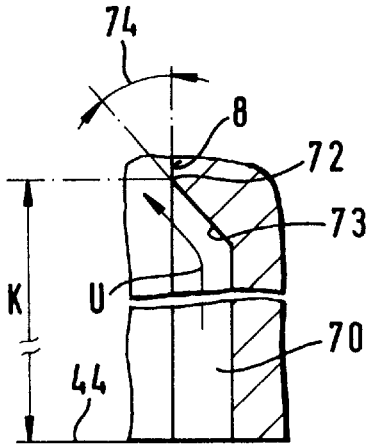
FIG. 10 is a detail section view along the line X—X of FIG. 9.

For a membrane-controlled inlet of the two-stroke engine, a support channel 70 can be arranged in the wall region 42 lying opposite the exhaust window 15 as shown in FIG. 9. The support channel 70 has a cross section which is essentially rectangular and lies symmetrically to the longitudinal center axis 43 of the cylinder 1. The exit window 71 of the support channel 70 is formed in a longitudinal side facing toward the cylinder bore 2. The edge of the exit window 71 facing toward the cylinder head 4 defines a control edge 72 (FIG. 10). The control edge 72 is defined by the upper edge of a roof surface 73 which delimits the axial end of the support channel 70 facing toward the cylinder head. The roof surface 73 and the cylinder wall 8 conjointly define an angle 74 of preferably 30°. The imaginary extension of the roof surface 73 intersects the elevation axis 41 of the cylinder 1 at an angle 74 of 30°.

The length K (FIG. 10) of the support channel 70 is measured from the lower cylinder edge 44 (FIG. 1) and is preferably less than the length L' of the support channel 10 and especially less than the length L of the main channel 9. This causes the control edge 72 of the support channel 70 being passed over later than the control edges 20 and 23 of the other transfer channels 9 and 10 when the piston 3 moves downwardly. The support channel 70 is then opened in time after the transfer channels 9 and 10 by a crankshaft angle of several degrees. The ancillary flow U entering into the combustion chamber from the support channel 70 supports the flow rising to the roof of the combustion chamber in the zone of the wall region 42. Scavenging of the combustion chamber and the thorough mixing of the transferred air/fuel mixture is improved.

In the embodiment shown in FIG. 9, the side wall 26 of the support channels 10 lies adjacent the support channel 70 at an angle 77 to the longitudinal center axis 43. This angle 77 is preferably 60°. The roof 21 of the transfer channel 10 (FIG. 7) is preferably at an angle of 45° with respect to the cylinder wall 8 or with respect to the cylinder elevation axis 41 in the embodiment of FIG. 9. The side walls 27 of the support channels 10 lie in a common plane 29 which extends between the cylinder elevation axis 41 and the wall region 42 and is perpendicular to the longitudinal center axis 43.

The side walls 32 of the main channels 9 are adjacent the exhaust channel 11 and lie at an angle 78 of preferably 20° to the longitudinal center axis 43. The intersect point P of the imaginary extensions of the side walls 32 then lie behind the support channel 70.

As shown further in FIG. 9, the bases 81 of the main channels 9 lie in a common plane 80 which extends approximately at the elevation of the exhaust window 15 and is perpendicular to the longitudinal center axis 43. The bases 88 of the support channels 10 preferably lie on a common circular arc having the radius R about the cylindrical elevation axis 41.

Figure 11:
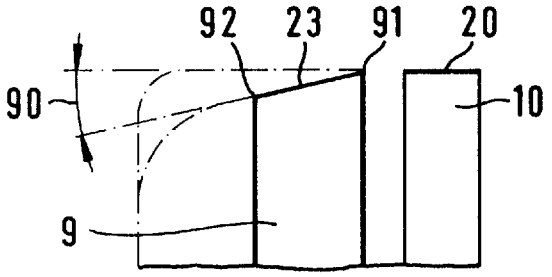
FIG. 11 is a detail view of the exit window of the transfer channels.
Figure 12:
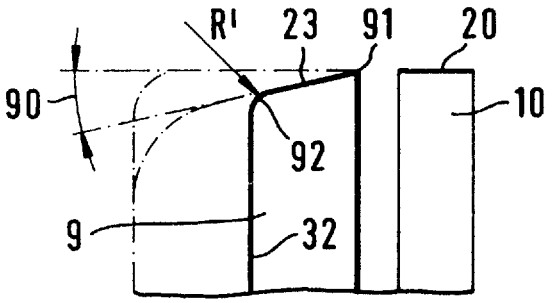
FIG. 12 is a detail view of a further embodiment of the exit window of the transfer channels.

It can be advantageous to configure the control edge 23 to be inclined in the peripheral direction of the cylinder wall 8 as shown in FIGS. 11 and 12. The inclination angle 90 is between approximately 0° and 15° and preferably has a magnitude of 10°. The angle 90 faces away from the support channel 10 so that the end 91 of the control edge 23 facing toward the support channel 10 lies higher than the end 92 of the control channel 23 of the main channel 9 facing away from the support channel 10. In the embodiment of FIG. 11, the end 91 of the control edge 23 of the main channel 9 lies at the same elevation as the control edge 20 of the support channel 10.

It can be advantageous to round the end 92 of the control edge 23 which faces away from the support channel 10 as shown in FIG. 12. The control edge 23 extends with a curvature R' into the side wall 32. The radius of curvature of the curve R' lies between 0 and 7 mm and preferably is 3 mm.

It is understood that the foregoing description is that of the preferred embodiments of the invention and that various changes and modifications may be made thereto without departing from the spirit and scope of the invention as defined in the appended claims.

What is claimed is:

1. A two-stroke engine for driving a crankshaft, the engine being for a portable handheld work apparatus such as a motor-driven chain saw, or a brushcutter, the two-stroke engine comprising:

a cylinder defining a longitudinal elevation axis and having a top wall and a cylindrical side wall terminating in said top wall;

a crankcase mounted below said cylinder for rotatably journalling said crankshaft;

a piston mounted in said cylinder so as to be movable along said side wall between top dead center and bottom dead center for driving said crankshaft;

said cylinder and said piston conjointly defining a combustion chamber wherein combustion gases are generated during operation of said engine;

said side wall of said cylinder having an exhaust window formed therein so as to open into said combustion chamber for conducting away said combustion gases;

said exhaust window defining a longitudinal center axis passing approximately through said elevation axis and said side wall of said cylinder having an inner wall surface portion lying opposite said exhaust window;

a plurality of main channels opening into said combustion chamber for conducting respective component main flows of fuel mixture into said combustion chamber;

a plurality of support channels opening into said combustion chamber for conducting respective component support flows of fuel mixture into said combustion chamber;

a first main channel and a first support channel arranged on a first side of said center axis and a second main channel and a second support channel arranged on a second side of said center axis;

said first and second main channels having first and second main channel exit windows lying adjacent said exhaust window so as to cause the respective component main flows to exit approximately horizontally toward said inner wall surface portion;

said first and second support channels having first and second support channel exit windows lying adjacent opposite vertical sides of said inner wall surface portion;

each of said support channels having a roof along which the component support flow corresponding thereto passes upwardly toward said top wall and approximately along a secant to said cylinder side wall near said inner wall surface portion;

each of said support channels having a channel segment terminating the exit window thereof; and, each of said exit windows of said support channels defining an upper control edge and said channel segment defining an edge step between said roof and said upper control edge.

2. The two-stroke engine of claim 1, said main channel exit windows being configured so as to cause said component main flows, respectively, to exit approximately along a tangent to said cylinder wall; and, said support channel exit windows being configured so as to cause said component support flows, respectively, to exit approximately along a secant to said cylindrical side wall.

3. The two-stroke engine of claim 1, said first and second main channel exit windows being at a greater distance (z) from said center axis than said first and second support channel exit windows.

4. The two-stroke engine of claim 1, each of said exit windows of said main channels being on a straight line passing through said elevation axis; and, said straight line being at right angles to said center axis.

5. The two-stroke engine of claim 1, each of said exit windows of said main channels having a first upper control edge and each of said exit windows of said support channels having a second upper control edge; and, said first upper control edges lying lower than said second upper control edges by a crankshaft angular amount (b).

6. The two-stroke engine of claim 1, each of said support channels having a channel segment terminating in the exit window thereof; and, said channel segment having a roof directed upwardly toward said top wall at an angle of approximately 35° to 65°.

7. The two-stroke engine of claim 6, said angle being 60°.

8. A two-stroke engine for driving a crankshaft, the engine being for a portable handheld work apparatus such as a motor-driven chain saw, or a brushcutter, the two-stroke engine comprising:

a cylinder defining a longitudinal elevation axis and having a top wall and a cylindrical side wall terminating in said top wall;

a crankcase mounted below said cylinder for rotatably journalling said crankshaft;

a piston mounted in said cylinder so as to be movable along said side wall between top dead center and bottom dead center for driving said crankshaft;

said cylinder and said piston conjointly defining a combustion chamber wherein combustion cases are generated during operation of said engine;

said side wall of said cylinder having an exhaust window formed therein so as to open into said combustion chamber for conducting away said combustion gases;

said exhaust window defining a longitudinal center axis passing approximately through said elevation axis and said side wall of said cylinder having an inner wall surface portion lying opposite said exhaust window;

a plurality of main channels opening into said combustion chamber for conducting respective component main flows of fuel mixture into said combustion chamber;

a plurality of support channels opening into said combustion chamber for conducting respective component support flows of fuel mixture into said combustion chamber;

first main channel and a first support channel arranged on a first side of said center axis and a second main channel and a second support channel arranged on a second side of said center axis;

said first and second main channels having first and second main channel exit windows lying adjacent said exhaust window so as to cause the respective component main flows to exit approximately horizontally toward said inner wall surface portion;

said first and second support channels having first and second support channel exit windows lying adjacent opposite sides of said inner wall surface portion;

each of said support channels having a roof alone which the component support flow corresponding thereto passes upwardly toward said top wall and approximately along a secant to said cylinder side wall near said inner wall surface portion;

each of said support channels having a channel segment terminating in the exit window thereof;

each of said exit windows of said support channels defining an upper control edge and said channel segment defining an edge step between said roof and said upper control edge;

said edge step being a planar surface against which the component support flow impinges; and, said planar surface defining a plane perpendicular to said longitudinal elevation axis.

9. The two-stroke engine of claim 8, said edge step having an axial depth (r) measured from said planar surface to said roof and a radial width (t) of 0 to 4 mm.

10. The two-stroke engine of claim 9, wherein said radial width (t) is 1 mm.

* * * * *

UNITED STATES PATENT AND TRADEMARK OFFICE

CERTIFICATE OF CORRECTION

PATENT NO. : 5,870,981
DATED : February 16, 1999
INVENTOR(S) : Konrad Knaus, Peter Pretzsch and Karel Jaros It is certified that error appears in the above-identified patent and that said Letters Patent is hereby corrected as shown below:

On the title page, under [56] References Cited, FOREIGN PATENT DOCUMENTS, insert: -- 0,964,364 11/1955 DE; 2,650,834 6/1977 DE; 1,021,378 3/1966 GB; and, 1,529,059 10/1978 GB --.

In column 3, line 47: delete "B" and substitute -- 8 -- therefor.

In column 8, line 24: between "terminating" and "the" insert -- in --.

In column 9, line 2: delete "cases" and substitute -- gases -- therefor.

In column 9, line 19: before "first main channel", insert -- a --

UNITED STATES PATENT AND TRADEMARK OFFICE

CERTIFICATE OF CORRECTION

PATENT NO. : 5,879,981

DATED : February 16, 1999

INVENTOR(S) : Konrad Knaus, Peter Pretzsch and Karel Jaros

It is certified that error appears in the above-identified patent and that said Letters Patent is hereby corrected as shown below:

In column 10, line 4: delete "alone" and substitute -- along -- therefor.

Signed and Sealed this

Tenth Day of August, 1999

*Attest:*

Q. TODD DICKINSON

*Attesting Officer*

*Acting Commissioner of Patents and Trademarks*